US006868701B2

(12) United States Patent
Lee

(10) Patent No.: US 6,868,701 B2
(45) Date of Patent: Mar. 22, 2005

(54) WASHING MACHINE EQUIPPED WITH MEANS FOR GENERATING MICROBUBBLES OF AIR

(76) Inventor: Yong Mi Lee, 16549 E. 14th St., Leandro, CA (US) 94578

( * ) Notice: Subject to any disclaimer, the term of this patent is extended or adjusted under 35 U.S.C. 154(b) by 410 days.

(21) Appl. No.: 10/171,184

(22) Filed: Jun. 14, 2002

(65) Prior Publication Data

US 2003/0230122 A1 Dec. 18, 2003

(51) Int. Cl.[7] ..... D06F 39/02
(52) U.S. Cl. ..... 68/183; 68/207
(58) Field of Search ..... 68/3 SS, 58, 142, 68/183, 207

(56) References Cited

U.S. PATENT DOCUMENTS

| | | | | |
|---|---|---|---|---|
| 1,743,788 A | * | 1/1930 | McKeon | 68/3 R |
| 1,948,568 A | * | 2/1934 | Faber et al. | 8/477 |
| 2,023,013 A | * | 12/1935 | Faber et al. | 8/159 |
| 2,219,490 A | * | 10/1940 | Pisarev | 8/111 |
| 2,453,620 A | | 11/1948 | Cathey et al. | |
| 2,778,499 A | | 1/1957 | Chamberlain et al. | |
| 4,031,006 A | | 6/1977 | Ramirez et al. | |
| 4,216,085 A | | 8/1980 | Chittenden | |
| 4,727,734 A | * | 3/1988 | Kanazawa et al. | 68/3 SS |
| 4,936,689 A | | 6/1990 | Federighi et al. | |
| 4,971,449 A | * | 11/1990 | Hendren | 366/228 |
| 5,167,798 A | | 12/1992 | Yoon et al. | |
| 5,253,380 A | * | 10/1993 | Lim et al. | 8/158 |
| 5,295,373 A | * | 3/1994 | Lim et al. | 68/12.05 |
| 5,307,649 A | * | 5/1994 | Lim et al. | 68/12.05 |
| 5,467,492 A | * | 11/1995 | Chao et al. | 8/159 |
| 5,590,551 A | | 1/1997 | Hong | |
| 5,651,276 A | * | 7/1997 | Purer et al. | 68/5 C |
| 5,653,129 A | * | 8/1997 | Jang | 68/13 R |
| 6,094,948 A | * | 8/2000 | Hong et al. | 68/183 |
| 6,170,303 B1 | * | 1/2001 | Hong et al. | 68/183 |

FOREIGN PATENT DOCUMENTS

| | | | |
|---|---|---|---|
| DE | 36 31 685 | * | 3/1988 |
| GB | 694918 | | 7/1953 |
| JP | 2-149293 | * | 6/1990 |

* cited by examiner

*Primary Examiner*—Frankie L. Stinson

(57) ABSTRACT

Disclosed is an improved washing machine equipped with means for generating microbubbles of air in the detergent-containing water circulated from and to the stationary outer tub of the washing machine. Disclosed means for generating microbubbles of air in the detergent-containing water circulated therethrough comprises: (a) an upstream detergent-containing water guide tube connected to the bottom portion of the stationary outer tub; (b) strainer means for filtering out fiber and other foreign object materials contained in the detergent-containing water, which is connected to the upstream water guide tube; (c) air-bubble introducing/feeding means into the detergent-containing water, which is connected to the strainer means; (d) a high-speed single-stage type or multi-stage type pump for generating microbubbles of air; (e) a motor coupled to the pump; (f) a plenum for the mixture of the microbubbles of air and the detergent-containing water under pressure; (g) a pressure-regulator valve for buildup of pressure for the mixture in the plenum; and (h) a downstream microbubble-containing water guide tube connected between the pressure-regulator valve and the outer tub so that the detergent-containing water in the outer tub is circulated therethrough as far as the pump is in operation; whereby each of the air bubbles introduced by suction or pressure feeding into the detergent-containing water through the air-bubble introducing means either by suction or by pressure feeding is dynamically broken into a plurality of microbubbles of air by the leading edge of rotor and/or stator blade of either high-speed single-stage or multi-stage pump.

19 Claims, 9 Drawing Sheets

WASHING MACHINE EQUIPPED WITH MEANS FOR GENERATING MICROBUBBLES OF AIR

BACKGROUND OF THE INVENTION

1. Field of the Invention

The present invention relates to a washing machine equipped with an apparatus of generating microbubbles of air in the detergent-containing water.

The process of generating microbubbles in the detergent-containing water for the washing machine has become widely employed as a cost-effective means for cleaning of laundry. The advantages of the washing machine with this process implemented therein comprise (a) that it reduces the amount of detergents to be added in the washer water introduced into the stationary tub of the washing machine; (b) that it prevents laundry in the rotating inner tub from being damaged or entangled; (c) that it requires shorter cleaning time and shows more thorough cleaning performance than the conventional washing machines devoid of means for generating microbubbles of air; and (d) that dry cleaning effect may be achieved even in wet cleaning together with this process so that sensitive laundry can successfully be taken care of.

2. Description of the Conventional Art

Key elements of the conventional bubble generating apparatus of the washing machines have been, so far, statically operating various gadgetries of microbubble generators such as the shear-generating turning elements or vanes developed by Federighi et al., U.S. Pat. No. 4,936,689; and the breaker of large bubbles into smaller ones as by Yoon et al., U.S. Pat. No. 5,167,798 even though its intended use is different from that for the washing machines. These gadgetries are, however, statically working devices playing a key role in generating bubbles in liquids inclusive of water. Other stationary devices such as the porous tubing, and various nozzles and orifices as developed by F. S. Gibbs, Inc., British Pat. No. 694,918 are to be cleaned up at a certain period of time interval to prevent foreign objects or object materials into which air bubbles are to be introduced from being stacked thereon to maintain the intended performance of the bubble generating means. Most of these stationary bubble generating devices have the potential of the problem of plugging because of the necessity for having finer pores or narrower passages of openings through which either the detergent-containing water or the air has to pass. If a choice of coarse porosity is made for the porous tubing or if nozzles having large openings are used to minimize the plugging problem, then the air bubble size will be too large to be useful for the washing machines.

Other problems with the conventional means for generating bubbles of air for the washing machine comprise (a) that washer water in the tub is hard to be circulated due to entrainment of fibrous or other foreeign object materials as developed from the laundry into the detergent-containing washer water circulated through these types of stationary bubble generating means, (b) that the bubble size cannot be made smaller than a certain critical value due to the fact that each of two mutually neighboring bubbles tend to get together to merge into a single bigger bubble with these stationary bubble generating means no matter how fast the flow of the detergent-containing water may be made, and that (c) as these conventional bubble generating apparatuses are basically in-line type devices and are disposed ahead of the detergent-containing water intake tube connected to the outer tub of the machine, number of bubbles in the detergent-containing water kept in the tub diminishes only due to absence of means for circulating the detergent-containing water in the stationary tub. Additionally, the shape of the bubble, that is the boundary between the detergent-containing water and the air, deviates much more from the true spherical one for large bubbles than for bubbles of smaller size. In other words, the rate of change in number of bubbles for larger bubbles is much higher than that of change for smaller bubbles for the same volumes of the detergent-containing water wherein microbubbles are introduced therein.

For these reasons set forth above, it is needed to have dynamically operating means for both generating microbubbles of air of smaller bubble size than that from the conventional statically working bubble generating means and keeping the rate of decrease in number of microbubbles generated as low as possible, uniformity in shape and size of the microbubbles generated in the detergent-containing water, and means for having therethrough circulation of the detergent-containing water in the tub of the machine with lessened plugging problems in order to keep a certain level of microbubbles contained in the detergent-containing water in the rotating inner tub of the machine.

SUMMARY OF THE INVENTION

It is an object of this invention to provide the washing machine with means for generating microbubbles of air in the detergent-containing water received by and kept in the stationary outer tub with a rotating inner tub disposed inside thereof so that the amount of detergents to be introduced into the detergent-containing water can be reduced to a minimum, resulting in lowest environmental contamination while preventing laundry in the revolving inner tub from being damaged or entangled, and having more thorough cleaning performance with the machine with reduced cleaning time and dry-cleaning effect as well so that sensitive laundry can successfully be taken care of even with the wet cleaning method.

A washing machine equipped with means for generating microbubbles of air in accordance with first version of the invention comprises: (1) a washing machine body; (2) an essentially stationary outer tub disposed inside of said washing machine body for receiving detergent-containing water therein and having at least one drain hole disposed in an outer surface thereof; (3) an inner tub disposed inside of said outer tub for taking the detergent-containing water and laundry therein and having at least one opening formed in a peripheral surface thereof; (4) means for rotating said inner tub, the rotating means being coupled to said inner tub; and (5) means for generating microbubbles of air in the detergent-containing water, which is disposed at a bottom portion of said outer tub; wherein said microbubble generating means comprises: (a) an upstream detergent-containing water guide tube connected to the outer tub; (b) strainer means for filtering out fibrous and other foreign object materials contained in the detergent-containing water, the strainer means being connected to the upstream detergent-containing water guide tube; (c) means for introducing air bubbles into the detergent-containing water, which is connected to the strainer means; (d) a high-speed single-stage type or multi-stage type pump for generating microbubbles of air, the pump being connected to downstream end of the air-bubble introducing means; (e) a motor coupled to the pump; (f) a plenum for a mixture of the detergent-containing water and the microbubbles of air; (g) a pressure-regulator valve connected to the plenum and set such that the mixture in between the exhaust port of the pump and the pressure-regulator valve is subject to a pressure higher than the ambient pressure; and (h) a downstream microbubble-containing water guide tube connected between said pressure-regulator valve and said outer tub so that the detergent-containing water in the outer tub is circulated therethrough as far as the pump is in operation; whereby each of the air bubbles introduced into the detergent-containing water through the air-bubble introducing means is physically broken into a plurality of microbubbles of air by a leading edge of one selected from a group consisting of at least one rotor vane of the pump, at least one stator vane of the pump, and each of at least one rotor vane and at least one stator vane of the pump.

A washing machine equipped with means for generating microbubbles of air in accordance with second version of the invention comprises five combinational prior-art constituent elements of the first version of the invention, wherein said microbubble generating means comprises: (a) an upstream detergent-containing water guide tube connected to the outer tub; (b) strainer means for filtering out fibrous and other foreign object materials contained in the detergent-containing water, the strainer means connected to the upstream detergent-containing water guide tube; (c) means for introducing air bubbles into the detergent-containing water, which is connected to the strainer means; (d) a high-speed single-stage type or multi-stage type pump for generating microbubbles of air, the pump being connected to downstream end of the air-bubble introducing means; (e) a motor coupled to the pump; (f) a pressure-regulator valve connected to the pump and set such that a mixture of the detergent-containing water and the microbubbles of air in between the exhaust port of the pump and the pressure-regulator valve is subject to a pressure higher than the ambient pressure; and (g) a downstream microbubble-containing water guide tube connected between said pressure-regulator valve and said outer tub so that the detergent-containing water in the outer tub is circulated therethrough as far as the pump is in operation; whereby each of the air bubbles introduced into the detergent-containing water through the air-bubble introducing means is physically broken into a plurality of microbubbles of air by a leading edge of one selected from a group consisting of at least one rotor vane of the pump, at least one stator vane of the pump, and each of at least one rotor vane and at least one stator vane of the pump.

In each of the first and second version of the invention, one exemplary embodiment to said means for introducing air bubbles into the detergent-containing water comprises: (a) a suction tube having at least one air suction opening formed in a circumferential surface thereof, and (b) means for confining said circumferential surface of the suction tube, an outer surface of the confinement means having therein at least one air inlet at an elevation not lower than that of the air suction opening disposed at the highest elevation among other air suction openings.

Also, alternative embodiment to said means for introducing air bubbles into the detergent-containing water comprises: (a) means for pressurizing air; (b) means for containing pressurized air from the air-pressurizing means, an outer surface of the containment means having therein a pressurized-air exhaust port and a pressurized-air intake port for intake of the pressurized air from the air-pressurizing means; (c) a pressure regulator connected to the pressurized-air exhaust port, (d) an air feeding tube having at least one air feeding opening formed in a circumferential surface thereof, upsteam and downstream end of which is connected to the strainer means and the intake port of the pump respectively; and (e) means for confining said circumferential surface of the air feeding tube, an outer surface of the confinement means having therein at least one air intake port connected to the pressure regulator; whereby the pressurized air in the containment means is supplied into the confinement means so that the pressurized air in the confinement means is fed through the air-feeding opening into the detergent-containing water flowing through the air-feeding tube.

A washing machine equipped with means for generating microbubbles of air in accordance with third version of the invention comprises five combinational prior-art constituent elements of the first version of the invention, wherein said microbubble generating means comprises: (a) an upstream detergent-containing water guide tube connected to the outer tub; (b) strainer means for filtering out fibrous and other foreign object materials contained in the detergent-containing water, the strainer means being connected to the upstream detergent-containing water guide tube; (c) a check valve connected to said strainer means such that the detergent-containing water past the check valve is prevented from flowing in reverse flow direction of the detergent-containing water; (d) means for feeding air bubbles into the detergent-containing water with solid materials contained in the detergent-containing water taken out by the strainer means, upstream end of which is connected to the check valve; (e) a high-speed single-stage type or multi-stage type pump for generating microbubbles of air, the pump being connected to downstream end of the air-bubble feeding means; (f) a motor coupled to the pump; (g) a plenum for a mixture of the detergent-containing water and the microbubbles of air; (h) a pressure-regulator valve connected to the plenum and set such that the mixture in between the exhaust port of the pump and the pressure-regulator valve is subject to a pressure higher than the ambient pressure; and (i) a downstream microbubble-containing water guide tube connected between said pressure-regulator valve and said outer tub so that the detergent-containing water in the outer tub is circulated therethrough as far as the pump is in operation; whereby each of the air bubbles fed into the detergent-containing water through the air-bubble feeding means is physically broken into a plurality of microbubbles of air by a leading edge of one selected from a group consisting of at least one rotor vane of the pump, at least one stator vane of the pump, and each of at least one rotor vane and at least one stator vane of the pump.

A washing machine equipped with means for generating microbubbles of air in accordance with fourth version of the invention comprises five combinational prior-art constituent elements of the first version of the invention, wherein said microbubble generating means comprises: (a) an upstream detergent-containing water guide tube connected to the outer tub; (b) strainer means for filtering out fibrous and other foreign object materials contained in the detergent-containing water, the strainer means being connected to the upstream detergent-containing water guide tube; (c) a check valve connected to said strainer means such that the detergent-containing water past the check valve is prevented from flowing in reverse flow direction of the detergent-containing water; (d) means for feeding air bubbles into the detergent-containing water with solid materials contained in the detergent-containing water taken out by the strainer means, upstream end of which is connected to the check valve; (e) a high-speed single-stage type or multi-stage type pump for generating microbubbles of air, the pump being connected to downstream end of the air-bubble feeding means; (f) a motor coupled to the pump; (g) a pressure-regulator valve connected to the exhaust port of the pump and set such that a mixture of the detergent-containing water and the microbubbles of air in between the exhaust port of the pump and the pressure-regulator valve is subject to a pressure higher than the ambient pressure; and (h) a downstream microbubble-containing water guide tube connected between said pressure-regulator valve and said outer tub so that the detergent-containing water in the outer tub is circulated therethrough as far as the pump is in operation; whereby each of the air bubbles fed into the detergent-containing water through the air-bubble feeding means is physically broken into a plurality of microbubbles of air by a leading edge of one selected from a group consisting of at least one rotor vane of the pump, at least one stator vane of the pump, and each of at least one rotor vane and at least one stator vane of the pump.

Also, in each of the third and fourth version of the invention, one exemplary embodiment to said means for feeding the air bubbles into the detergent-containing water comprises: (a) means for pressuring air; (b) means for containing pressurized air from the air-pressurizing means, an outer surface of the containment means having therein a pressurized-air exhaust port and a pressurized-air intake port for intake of the pressurized air from the air-pressurizing means; (c) a pressure regulator connected to the pressurized-air exhaust port; (d) an air feeding tube having at least one air feeding opening formed in a circumferential surface thereof, upsteam and downstream end of which is connected to the check valve and the intake port of the pump respectively; and (e) means for confining said circumferential surface of the air feeding tube, an outer surface of the confinement means having therein at least one air intake port connected to the pressure regulator; whereby the pressurized air in the containment means is supplied into the confinement means so that the pressurized air in the confinement means is fed through the air-feeding opening into the detergent-containing water flowing through the air-feeding tube.

A washing machine equipped with means for generating microbubbles of air in accordance with fifth version of the invention comprises five combinational prior-art constituent elements of the first version of the invention, wherein said microbubble generating means comprises: (a) an upstream detergent-containing water guide tube connected to said outer tub; (b) strainer means for filtering out fibrous and other foreign object materials contained in the detergent-containing water, upsteam end of which is connected to the upstream water guide tube; (c) means for introducing air bubbles into the detergent-containing water with solid materials contained in the detergent-containing water taken out by the strainer means, upstream end of which is connected to downstream end of said strainer means; (d) a check valve connected to downstream end of said air-bubble introducing means such that the detergent-containing water past the air-bubble introducing means is prevented from flowing in reverse flow direction of the detergent-containing water; (e) a high-speed single-stage type or multi-stage type pump for generating microbubbles of air, the pump being connected to the check valve; (f) a motor coupled to the pump; (g) a plenum for a mixture of the detergent-containing water and the microbubbles of air; (h) a pressure-regulator valve connected to the plenum and set such that a mixture of the detergent-containing water and the microbubbles of air in between the exhaust port of the pump and the pressure-regulator valve is subject to a pressure higher than the ambient pressure; and (i) a downstream microbubble-containing water guide tube connected between said pressure-regulator valve and said outer tub so that the detergent-containing water in the outer tub is circulated therethrough as far as the pump is in operation; whereby each of the air bubbles fed into the detergent-containing water through the air-bubble introducing means is physically broken into a plurality of microbubbles of air by a leading edge of one selected from a group consisting of at least one rotor vane of the pump, at least one stator vane of the pump, and each of at least one rotor vane and at least one stator vane of the pump.

A washing machine equipped with means for generating microbubbles of air in accordance with sixth version of the invention comprises five combinational prior-art constituent elements of the first version of the invention, wherein said microbubble generating means comprises: (a) an upstream detergent-containing water guide tube connected to said outer tub; (b) strainer means for filtering out fibrous and other foreign object materials contained in the detergent-containing water, upsteam end of which is connected to the upstream water guide tube; (c) means for introducing air bubbles into the detergent-containing water with solid materials contained in the detergent-containing water taken out by the strainer means, upstream end of which is connected to downstream end of said strainer means; (d) a check valve connected to downstream end of said air-bubble introducing means such that the detergent-containing water past the air-bubble introducing means is prevented from flowing in reverse flow direction of the detergent-containing water; (e) a high-speed single-stage type or multi-stage type pump for generating microbubbles of air, the pump being connected to the check valve; (f) a motor coupled to the pump; (g) a pressure-regulator valve connected to the exhaust port of the pump and set such that the mixture in between the exhaust port of the pump and the pressure-regulator valve is subject to a pressure higher than the ambient pressure; and (h) a downstream microbubble-containing water guide tube connected between said pressure-regulator valve and said outer tub so that the detergent-containing water in the outer tub is circulated therethrough as far as the pump is in operation; whereby each of the air bubbles fed into the detergent-containing water through the air-bubble introducing means is physically broken into a plurality of microbubbles of air by a leading edge of one selected from a group consisting of at least one rotor vane of the pump, at least one stator vane of the pump, and each of at least one rotor vane and at least one stator vane of the pump.

In each of the fifth and sixth version of the invention, one exemplary embodiment to said means for introducing air bubbles into the detergent-containing water comprises: (a) a suction tube having at least one air suction opening formed in a circumferential surface thereof, upsteam and downstream end of which is connected to the downstream end of the strainer means and the check valve respectively; and (b) means for confining said circumferential surface of the suction tube, an outer surface of the confinement means having therein at least one air inlet at an elevation not lower than that of the air suction opening disposed at the highest elevation among other air suction openings.

Also, alternative embodiment to said means for introducing air bubbles into the detergent-containing water comprises: (a) means for pressuring air; (b) means for containing pressurized air from the air-pressurizing means, an outer surface of the containment means having therein a pressurized-air exhaust port and a pressurized-air intake port for intake of the pressurized air from the air-pressurizing means; (c) a pressure regulator, one end of which is connected to the pressurized-air exhaust port; (d) an air feeding tube having at least one air feeding opening formed in a circumferential surface thereof, upsteam and downstream end of which is connected to the downstream end the strainer means and the upstream end of the check valve respectively; and (e) means for confining said circumferential surface of the air feeding tube, an outer surface of the confinement means having therein at least one air intake port connected to the other end of the pressure regulator; whereby the pressurized air in the containment means is supplied into the confinement means so that the pressurized air in the confinement means is fed through the air-feeding opening into the detergent-containing water flowing through the air-feeding tube.

DETAILED DESCRIPTION OF THE INVENTION

Figure 1:
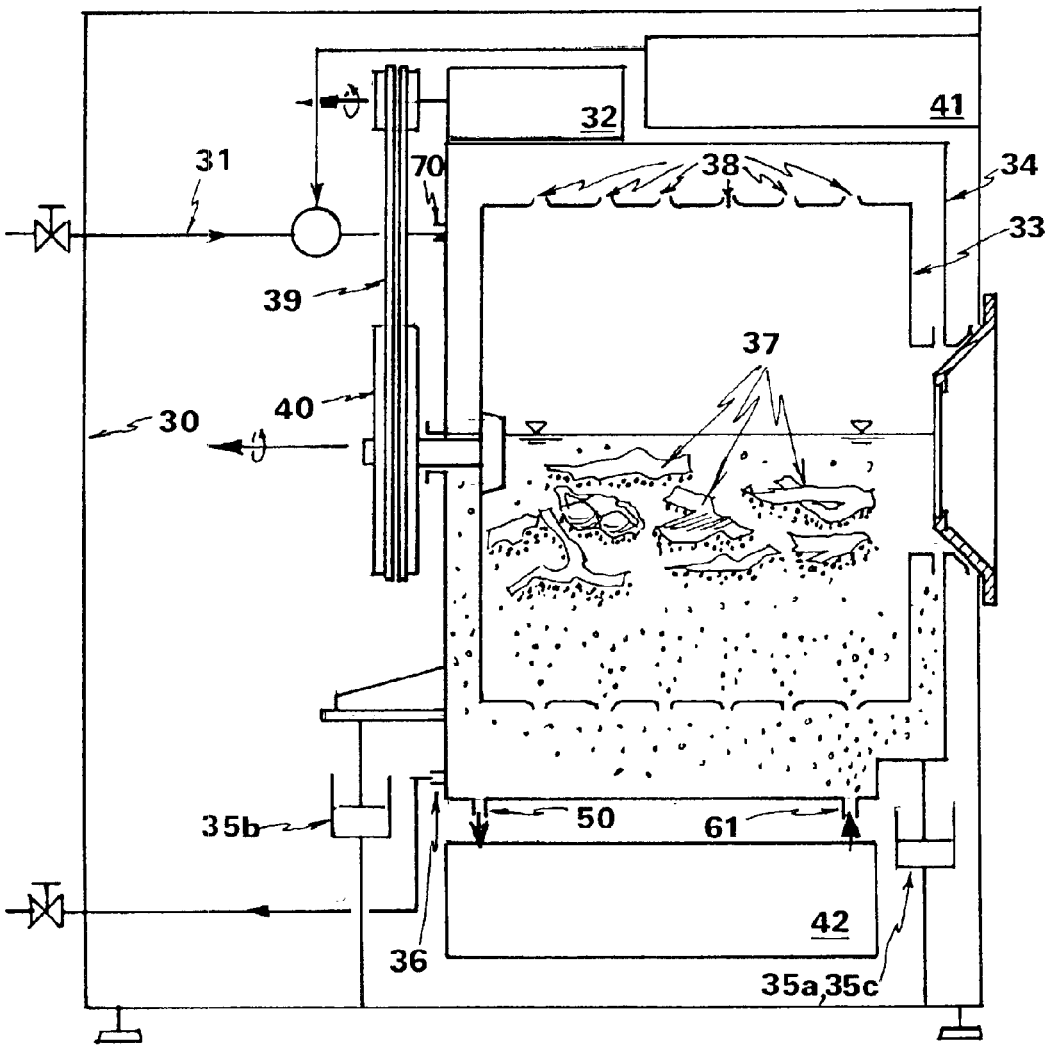
FIG. 1 is a schematic longitudinal sectional view of prior-art constituent elements of the washing machine equipped with means for generating microbubbles of air in the detergent-containing water received by and kept in an outer tub of the washing machine in accordance with the present invention.

FIG. 1 is a schematic longitudinal sectional view of prior-art constituent elements of the washing machine equipped with means for generating microbubbles of air 42 in the detergent-containing water received by and kept in an outer tub of the washing machine in accordance with the present invention.

The conventional commercial washing machine equipped with means for generating microbubbles of air typically comprises: (1) a washing machine body 30 wherein city water intake tube 31, detergent-supply apparatus 41 connected to a middle or an end portion of the city water intake tube 31, a drive motor 32 for rotational drive of an inner tub 33, and other miscellaneous electro-mechanical/electronic control elements for control of the machine including solenoid valves are accommodated; (2) an essentially stationary outer tub 34 mounted on the lower frame of the washing machine body 30 typically with three shock-absorbing supports 35*a*,35*b*,35*c* in between, disposed inside of said washing machine body 30 for receiving detergent-containing water therein, and having at least one drain hole 36 usually disposed at the lowest elevation and in an outer surface thereof; (3) an inner tub 33 disposed inside of said outer tub 34 for taking the detergent-containing water and laundry 37 therein and having typically multiplicity of openings 38 formed in a peripheral surface thereof such that detergent-containing water therein can be drained completely when it is rotationally driven by a drive motor 32 for dehydration from the laundry 37; (4) means for rotating said inner tub, which includes the drive motor 32, and motor-power transmitting means which comprises typically a plurality of V-belts 39 and a V-belt pulley 40 usually in horizontal alignment with an axis of rotation of the inner tub 32 for commercial washing machine while it is in vertical alignment for household washers; and finally (5) means for generating microbubbles of air in the detergent-containing water, which is disposed at a bottom portion of the washing machine body and is connected to the outer tub 34.

The microbubble generating means 42 in accordance with the present invention includes: (a) an upstream detergent-containing water guide tube 50 connected to said outer tub 34; (b) strainer means for filtering out fibrous materials contained in the detergent-containing water, the strainer means connected to the upstream detergent-containing water guide tube 50; (c) means for introducing or pressure-feeding air bubbles into the detergent-containing water; (d) a high-speed single-stage type or multi-stage type pump for generating microbubbles of air; (e) a motor coupled to the pump; (f) a plenum for storing a mixture of the detergent-containing water and microbubbles of air generated by the pump; (g) a pressure-regulator valve for regulating pressure of the mixture stored in the plenum; and finally (h) a downstream microbubble-containing water guide tube 61 connected between said pressure-regulator valve and said outer tub 34 so that water in the outer tub 34 is circulated therethrough as far as the pump is in operation; whereby each of the air bubbles introduced into the detergent-containing water through the air-bubble introducing means is physically broken into two microbubbles of air by a leading edge of each of rotor vanes, stator vanes, or both of said two of the pump.

Figure 2:
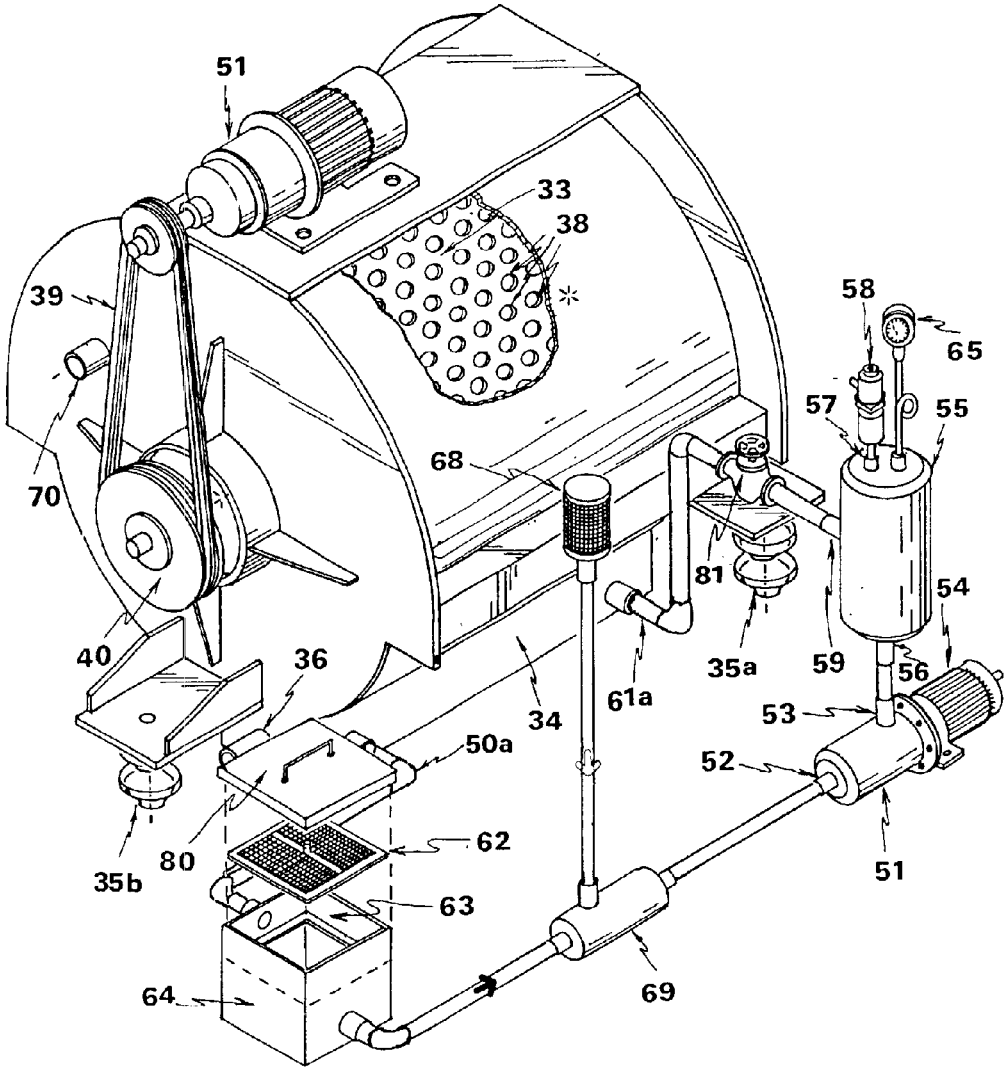
FIG. 2 shows a three-dimensional view of an embodiment of the microbubble generating means in accordance with the first version of the present invention, wherein an embodiment of air-bubble introducing means is implemented.
Figure 4:
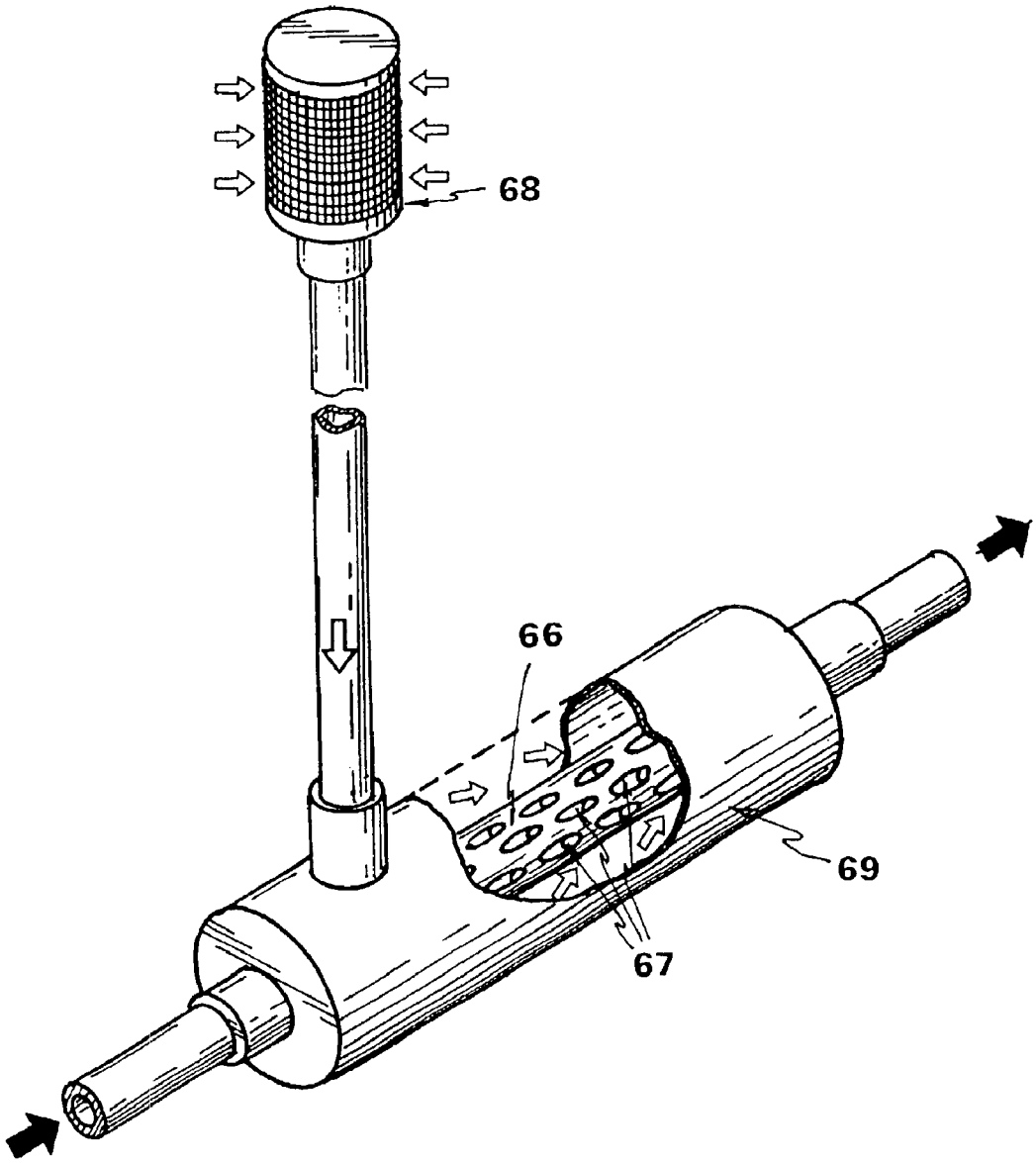
FIG. 4 reveals an exploded view of the embodiment of the air-bubble introducing means as shown in FIG. 3.

A three-dimensional view of an embodiment of the microbubble generating means of the washing machine in accordance with the first version of the present invention is illustrated in FIG. 2. One end of the upstream detergent-containing water guide tube 50*a* is connected to virtually stationary said outer tub 34. As the microbubble generating means 42 is typically mounted on the lower frame of the washing machine body 30, the upstream detergent-containing water guide tube 50*a* is usually formed of a flexible rubber tubing to block the vibration of the outer tub 34 from being transmitted to the microbubble generating means 42. Connected to the downstream end of the upstream water guide tube 50*a* is a strainer assembly consisting of a strainer assembly having a square pocket 63 and a filtered-water compartment 64 therein, a strainer mesh plate 62 to be fitted in the square pocket 63, and a strainer lid 80 equipped with means for hermetically sealing the strainer assembly. The strainer assembly is then connected to an air-bubble introducing apparatus of which a partially cut-away view of one embodiment thereof is illustrated in FIG. 4. The detergent-containing water with air bubbles therein past the air-bubble introducing apparatus is then sucked by a high-speed pump 51 with a motor 54 coupled thereto for generating microbubbles of air, which has one intake port 52 connected to downstream end of said air-bubble introducing apparatus and one exhaust port 53 for exhaust of a mixture of the detergent-containing water and the microbubbles of air. The microbubble generating means equipped for conventional washing machines is of in-line type while one of the characteristic features of the microbubble generating means in accordance with the present invention is that the microbubble generation is made in the detergent-containing water circulating from and to the outer tub 34. The mixture is then sent to a plenum 55 having an intake hole 56 disposed at a bottom portion of an outer surface thereof for intake of the mixture supplied through the exhaust port 53 of the pump 51, an air vent hole 57 disposed at a top portion of the outer surface thereof in which a pressure relief valve 58 is plugged for preservation of safety therefor, and an exhaust opening 59 disposed in the outer surface thereof for exhaust of the mixture, the exhaust opening 59 being disposed at an elevation lower than that of the air vent hole 57. A pressure-regulator valve 81 is then connected to the exhaust opening 59 and set such that the mixture in between the exhaust port 53 of the pump 51 and the pressure-regulator valve 81 is subject to a pressure higher than the ambient pressure. The final subcombinational elements of the microbubble generating means is a downstream microbubble-containing water guide tube 61*a* connected between said pressure-regulator valve 81 and said outer tub 34 so that water in the outer tub 34 is circulated therethrough as far as the pump 51 is in operation; whereby each of the air bubbles introduced into the detergent-containing water through the air-bubble introducing means is dynamically broken into two microbubbles of air by a leading edge of rotor vanes or stator vanes, or both of said two of the pump 51. One of the advantages of implementing microbubble generating means in circulatory configuration over existing means for generating microbubbles in the intake city water supplied into the outer tub of the conventional washing machine equipped with microbubble generating apparatus is that the air-bubble density in the detergent-containing water in the outer tub 34 is at least not lowered as the washing processes go on while that for the conventional machines is getting lowered due to the fact that mutually neighboring microbubbles in the detergent-containing water in the outer tub tend to merge into a bigger air bubble although this phenomenon is also true for the washing machines of the present invention. It is noted that the direction of flow of the detergent-containing water is indicated with a blunt-nosed blackened arrow.

Figure 3:
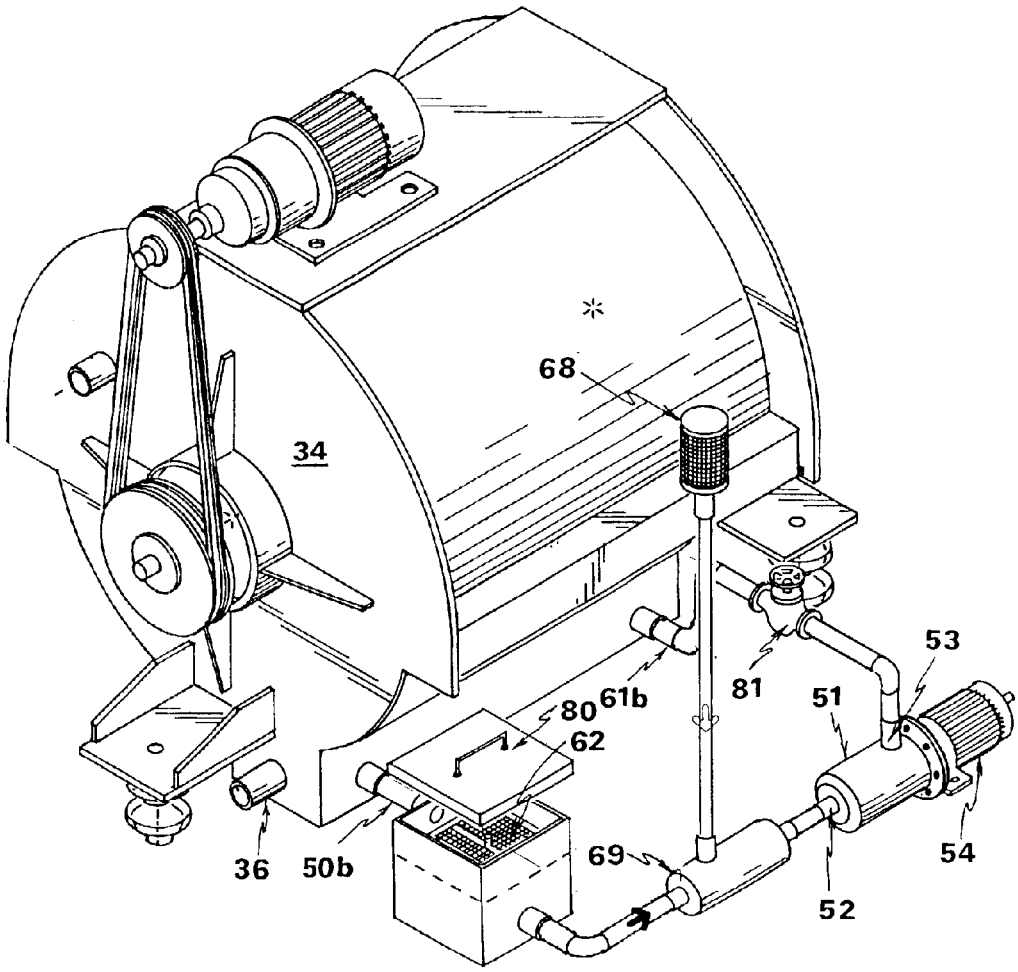
FIG. 3 is a three-dimensional view of an embodiment of the microbubble generating means of the washing machine in accordance with second version of the invention, wherein the same embodiment of air-bubble introducing means as shown in FIG. 2 is implemented.

FIG. 3 is a three-dimensional view of an embodiment of the microbubble generating means of the washing machine in accordance with second version of the invention, wherein the same embodiment of air-bubble introducing means as shown in FIG. 2 is implemented. The only difference compared with the embodiment of the microbubble generating means in compliance with the first version of the invention as shown in FIG. 2 is that there is no plenum 55 present in this version of the microbubble generating means. Instead of omitting the plenum 55, it may be necessary to place a pressure gauge 65, shown in FIG. 2, ahead of the pressure-regulator valve 81 for adjustment of pressure setting therefor. It is also noted that the direction of flow of air taken through an air intake strainer 68 is indicated with a blunt-nosed white arrow.

FIG. 4 reveals an exploded view of the embodiment of the air-bubble introducing means as shown in FIG. 3. A suction tube 66 having multiplicity of air suction openings 67 formed in a circumferential surface thereof is hermetically enclosed by a suction-tube enclosure casing 69 in such a way that the air supplied through an air intake strainer 68 disposed at an elevation not lower than that of the maximum possible level of the detergent-containing water in the outer tub 34 and connected to the suction-tube enclosure casing 69 is introduced into the detergent-containing water flowing through the suction tube 66. Each of the air suction openings 67 is directed to suck air therethrough. It is to be noted that even if inside space of the suction-tube enclosure casing 69 is flooded with the detergent-containing water so that the suction tube 66 is fully submerged in the detergent-containing water as prior to operation of the washing machine, air suction is supposed to be made through the suction openings 67 after a short period of time once the pumping of the detergent-containing water by turning the motor 54 on due to the fact that the magnitude of pressure of the detergent-containing water ahead of the pump 51 is lower than that of the ambient pressure. Instead of the suction tube 66, varieties of other tubes having other types of preferably fine openings disposed in the outer surface thereof may be used for introducing air bubbles into the detergent-containing water flowing through such tube as a prior process for generating microbubbles afterwards.

Figure 5:
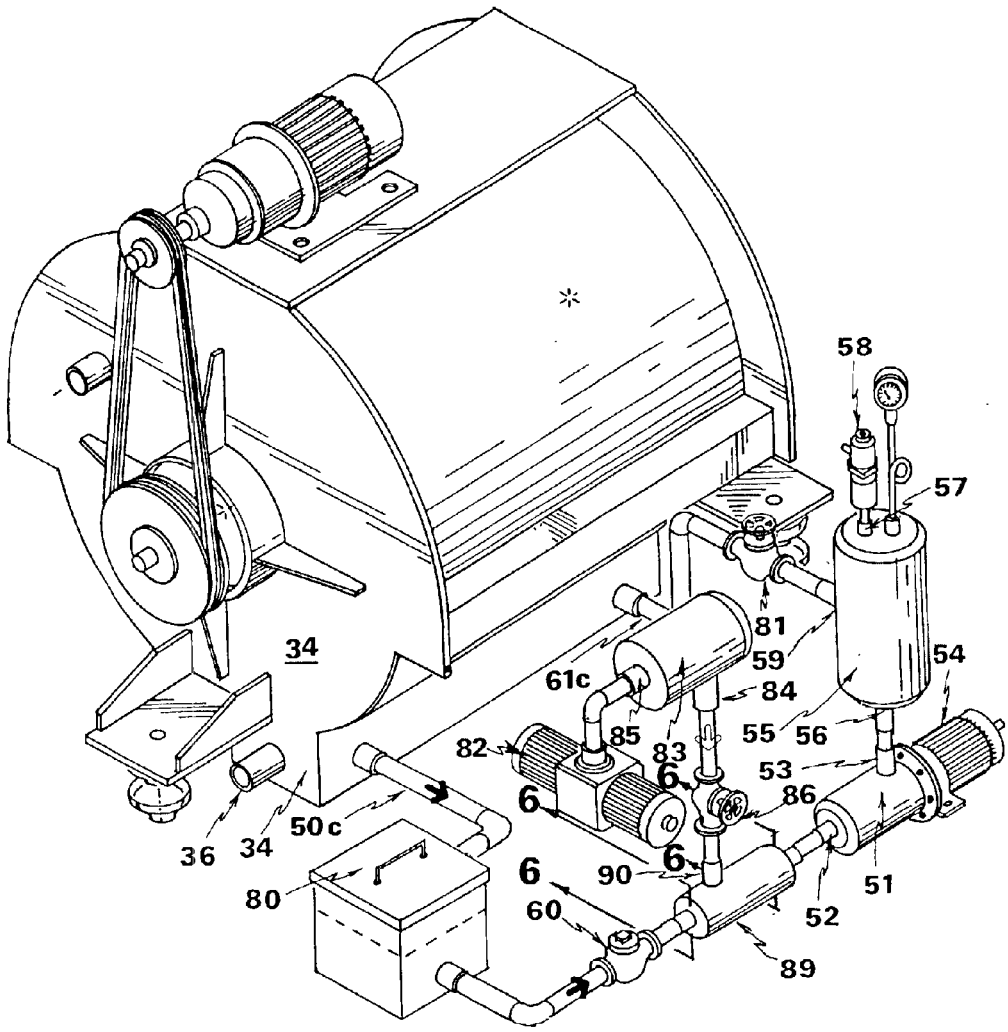
FIG. 5 shows a three-dimensional view of an embodiment of the microbubble generating means of the washing machine in accordance with third version of the invention, wherein an embodiment of means for feeding air bubbles into the detergent-containing water is implemented.

FIG. 5 shows a three-dimensional view of an embodiment of the microbubble generating means of the washing machine in accordance with third version of the invention, wherein an embodiment of means for feeding air bubbles into the detergent-containing water is implemented. An embodiment of the microbubble generating means in compliance with this version comprises: (a) an upstream detergent-containing water guide tube 50*c* connected to said outer tub 34; (b) strainer assembly for filtering out fibrous materials, as shown in FIG. 2 and FIG. 3, upsteam end of which is connected to said upsteam water guide tube 50*c*; (c) a check valve 60 connected to said strainer assembly such that the detergent-containing water past the check valve 60 is prevented from flowing in reverse flow direction of the detergent-containing water; (d) an air-bubble feeding apparatus for feeding air bubbles into the detergent-containing water, upstream end of which is connected to the check valve 60; (e) a pump 51 for generating microbubbles of air, which has one intake port 52 connected to the air-bubble feeding apparatus and one exhaust port 53 for exhaust of a mixture of the detergent-containing water and the microbubbles of air; (f) a motor 54 coupled to the pump 51; (g) a plenum 55 for the mixture having an intake hole 56 disposed at a bottom portion of an outer surface thereof for intake of the mixture supplied through the exhaust port 53 of the pump 51, an air vent hole 57 disposed at a top portion of the outer surface thereof in which a pressure relief valve 58 is fitted for preservation of safety therefor, and an exhaust opening 59 disposed in the outer surface thereof for exhaust of the mixture, the exhaust opening 59 being disposed in an elevation lower than that of the air vent hole 57; (h) a pressure-regulator valve 81 connected to the exhaust opening 59 and set such that the mixture in between the exhaust port 53 of the pump 51 and the pressure-regulator valve 81 is subject to a pressure higher than the ambient pressure; and finally (i) a downstream microbubble-containing water guide tube 61*c* connected between said pressure-regulator valve 81 and said outer tub 34 so that water in the outer tub 34 is circulated therethrough as far as the pump 51 is in operation; whereby each of the air bubbles fed into the detergent-containing water through the air-bubble feeding apparatus is dynamically broken into two microbubbles of air by a leading edge of rotor vanes or stator vanes, or both of said two of the pump 51.

The air-bubble feeding means implemented in the embodiment consists of: (a) an air compressor 82 as an embodiment to means for pressuring air; (b) a containment tank 83 having a pressurized-air exhaust port 84 and a pressurized-air intake port 85 for intake of the pressurized air from the air compressor 82 in an outer surface thereof; (c) a pressure regulator 86, one end of which is connected to the pressurized-air exhaust port 84; (d) an air feeding tube 87, shown in FIG. 6, having an air feeding opening 88, also shown in FIG. 6, formed in a circumferential surface thereof, upsteam and downstream end of which is connected to the check valve 60 and the intake port 52 of the pump 51 respectively; and (e) an air-feeding-tube enclosure casing 89 as an embodiment to means for confining said circumferential surface of the air feeding tube 87, an outer surface of the air-feeding-tube enclosure casing 89 having therein an air intake port 90 connected to the other end of the pressure regulator 86; whereby the pressurized air in the containment tank 83 is supplied into the air-feeding-tube enclosure casing 89 so that the pressurized air in the air-feeding-tube enclosure casing 89 is fed through the air-feeding opening 88, shown in FIG. 6, into the detergent-containing water flowing through the air-feeding tube 87.

Figure 6:
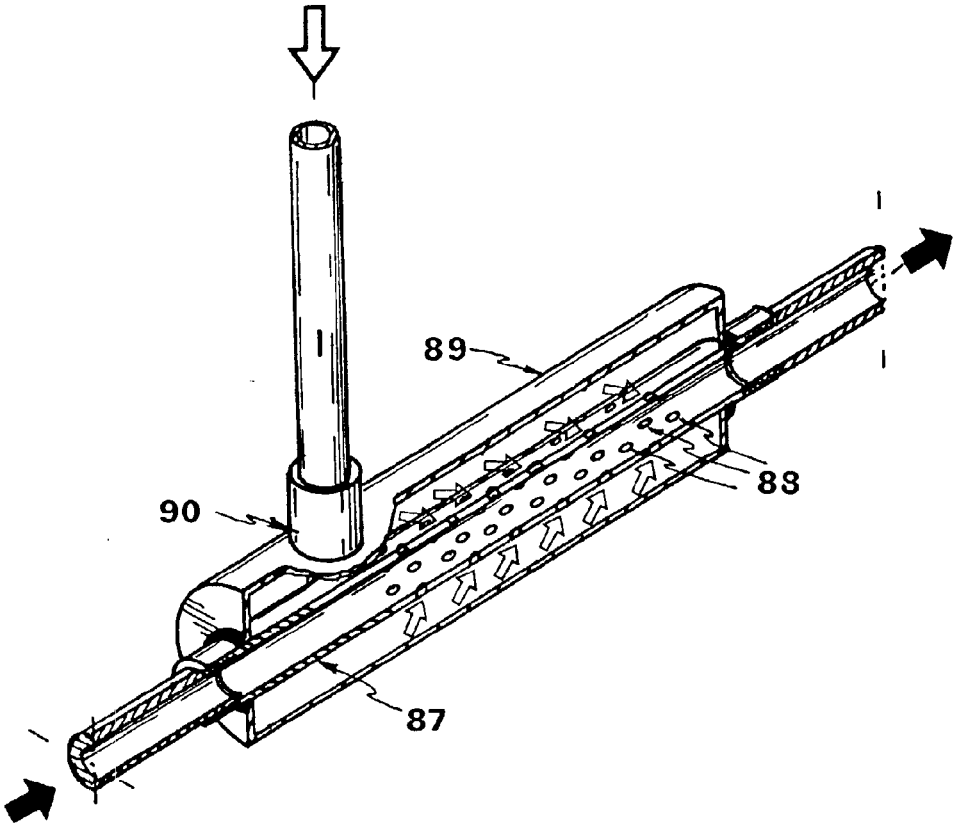
FIG. 6 shows a longitudinal sectional view of the embodiment of the air-bubble feeding means taken along 6—6—6—6 in FIG. 5.

FIG. 6 shows a longitudinal sectional view of the embodiment of the air-bubble feeding apparatus taken along 6—6—6—6 in FIG. 5. It is believed to be worthwhile to mention here that it is needed that the size of the air feeding openings 88 be relatively much smaller than that of the suction opening 67 as disclosed in FIG. 4 to avoid coarse two-phase flow of air-bubble containing water into the intake port 52 of the pump 51. The coarse two-phase flow may incur what is called a "sponge effect" of the pumping operation, resulting in a negative influence on the pump performance characterized by an intermittent pumping operation of the pump 51. Alternative embodiment to the air feeding tube 87 having the air-feeding opening 88 on the circumferential surface thereof can be a tube formed of porous tubular material.

Figure 7:
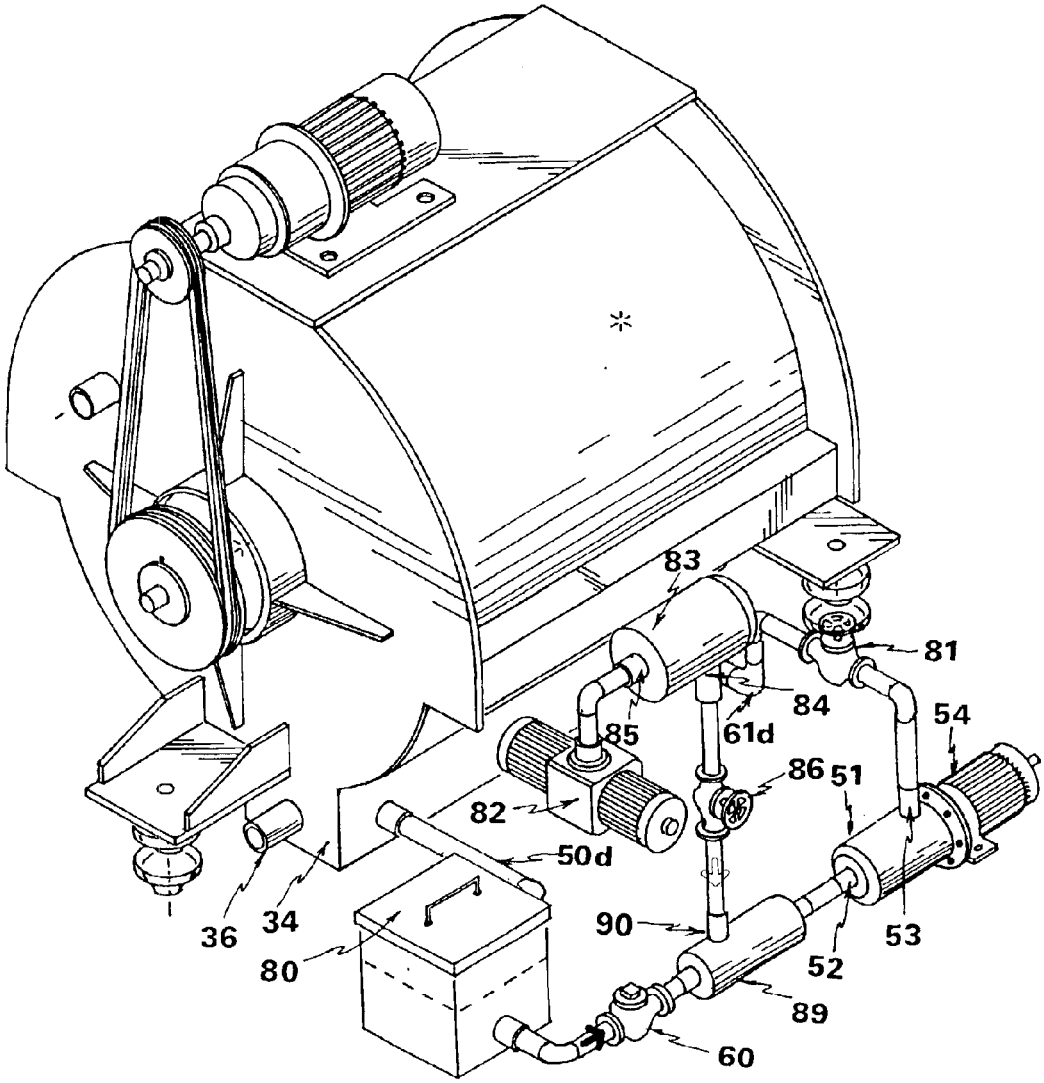
FIG. 7 illustrates a three-dimensional view of an embodiment of the microbubble generating means of the washing machine in accordance with fourth version of the invention.

FIG. 7 illustrates a three-dimensional view of an embodiment of the microbubble generating means of the washing machine in accordance with fourth version of the invention. The only difference, here again, as compared with the microbubble generating means as disclosed in FIG. 5 is that there is no plenum 55 present in this version of the microbubble generating means. One important empirical data in regard to the pressure setting for the downstream pressure-regulator valve 81 for maximum performance of the density of the microbubbles generated through the microbubble generating means of each of six versions of the present invention including two more versions of the microbubble generating means as shown in FIGS. 8 and 9 is that the pressure range for the setting be in a range of 4 to 6 kgf/cm$^2$.

Figure 8:
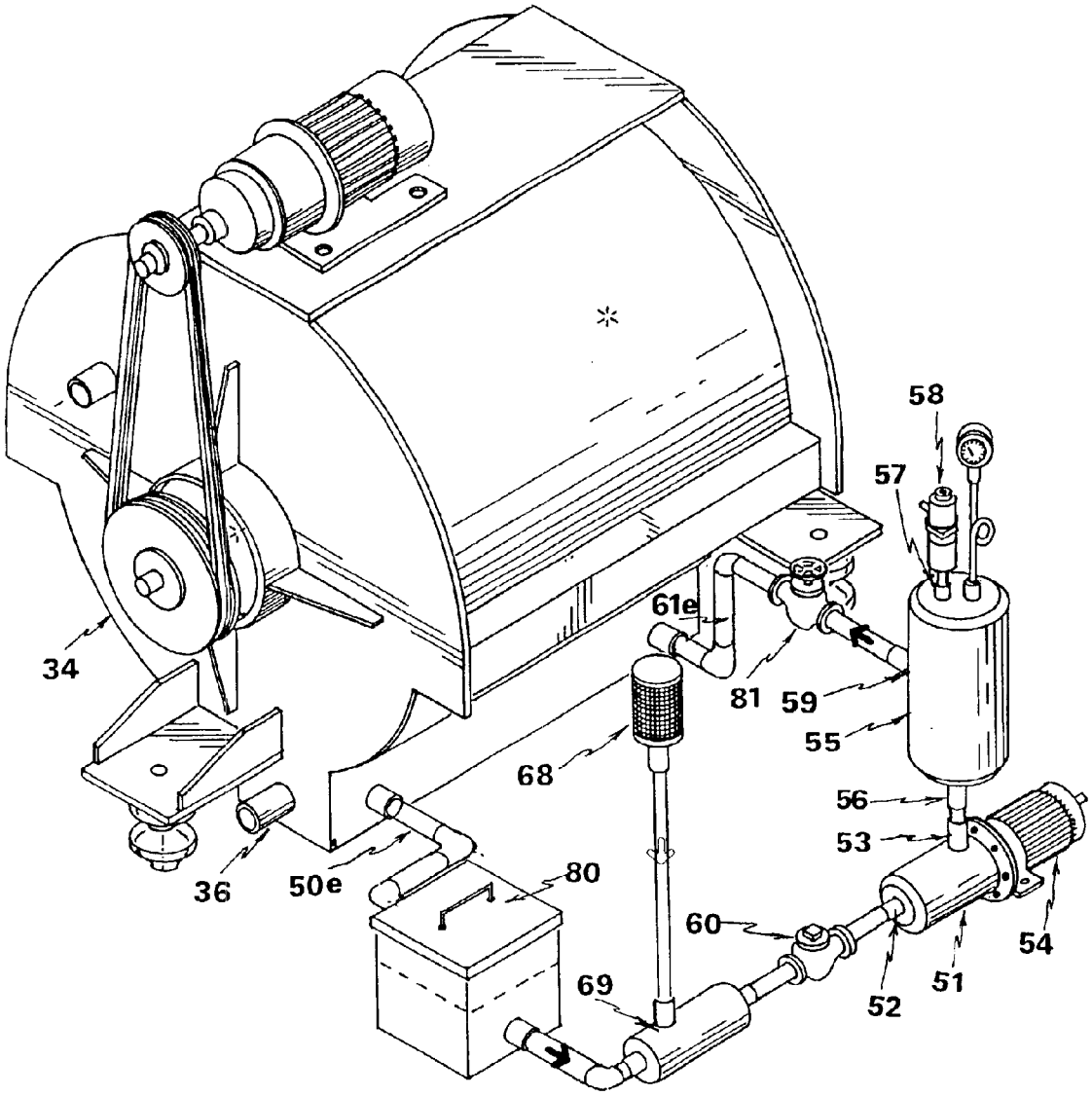
FIG. 8 shows a three-dimensional view of an embodiment of the microbubble generating means of the washing machine in accordance with fifth version of the invention, wherein an embodiment of the means for introducing air bubbles into the detergent-containing water is implemented.

FIG. 8 shows a three-dimensional view of an embodiment of the microbubble generating means of the washing machine in accordance with fifth version of the invention, wherein an embodiment of the means for introducing air bubbles into the detergent-containing water is implemented. An embodiment of the microbubble generating means in this version comprises: (a) an upstream detergent-containing water guide tube 50*e*, one end of which is connected to said outer tub 34; (b) a strainer assembly for filtering out fibrous materials contained in the detergent-containing water, upsteam end of which is connected to the other end of the upstream water guide tube 50*e*; (c) air-bubble introducing apparatus for introducing air into the detergent-containing water with solid materials contained in the detergent-containing water taken out by the strainer assembly, upstream end of which is connected to downstream end of the strainer assembly; (d) a check valve 60, upstream end of which is connected to downstream end of said air-bubble introducing apparatus such that the detergent-containing water past the air-bubble introducing apparatus is prevented from flowing in reverse flow direction of the detergent-containing water; (e) a pump 51 for generating microbubbles of air, which has one intake port 52 connected to downstream end of the check valve 60 and one exhaust port 53 for a mixture of the detergent-containing water and the microbubbles of air; (f) a motor 54 coupled to the pump 51; (g) a plenum 55 for the mixture having an intake hole 56 disposed at a bottom portion of an outer surface thereof for intake of the mixture supplied through the exhaust port 53 of the pump 51, an air vent hole 57 disposed at a top portion of the outer surface thereof to which a pressure relief valve 58 is installed as a precautionary measure for preservation of safety therefor, and an exhaust opening 59 disposed in the outer surface thereof for exhaust of the mixture and at an elevation lower than that of the air vent hole 57; (h) a pressure-regulator valve 81 connected to the exhaust opening 59 and set such that the mixture in between the exhaust port 53 of the pump 51 and the pressure-regulator valve 81 is subject to a pressure higher than the ambient pressure; and (i) a downstream microbubble-containing water guide tube 61 connected between said pressure-regulator valve 81 and said outer tub 34 so that the detergent-containing water in the outer tub 34 is circulated therethrough as far as the pump 51 is in operation; whereby each of the air bubbles introduced into the detergent-containing water through the air-bubble introducing means is dynamically broken into two microbubbles of air by a leading edge of rotor vanes or stator vanes, or both of said two of the pump 51.

Figure 9:
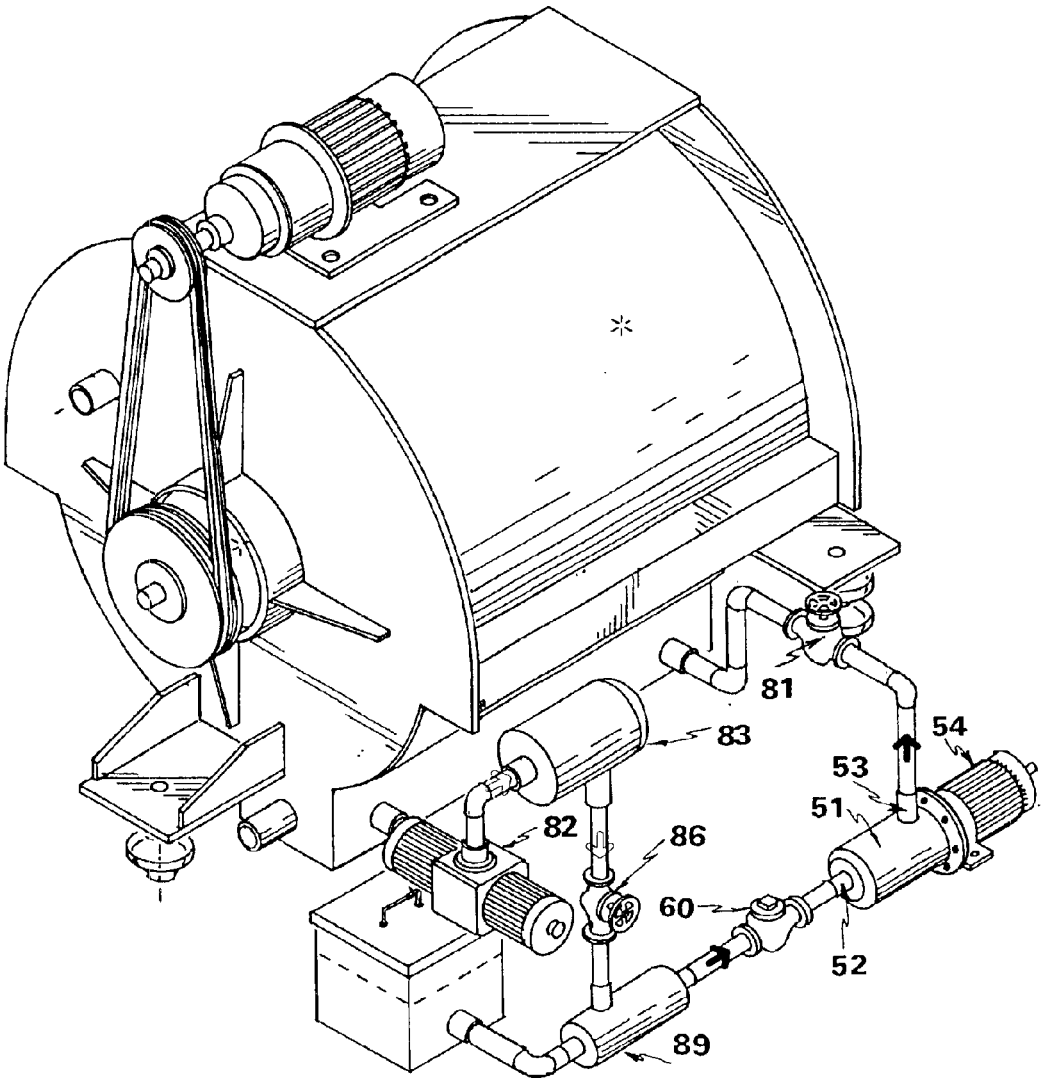
FIG. 9 discloses a three-dimensional view of an embodiment of the microbubble generating means of the washing machine in accordance with sixth version of the invention, wherein air bubbles are introduced into the detergent-containing water by pressure.

Finally, FIG. 9 discloses a three-dimensional view of an embodiment of the microbubble generating means of the washing machine in accordance with sixth version of the invention, wherein an embodiment of the means for feeding air bubbles into the detergent-containing water as disclosed in FIGS. 5 and 7 is disclosed. While bearing in mind that the air-bubble introduction into the detergent-containing water can be made by suction or by pressure feeding of air due to the fact that the air-bubble introduction is made ahead of the check valve 60 for each of the fifth and six versions of the microbubble-generating means in accordance with the present invention, a sole difference as compared with the microbubble generating means as disclosed in FIG. 8 is that there is no plenum 55 present in this version of the microbubble generating means again. Either one of the air-bubble introducing means and air-bubble feeding means may well be implemented in the microbubble generating means in any one of the fifth and sixth version of the invention as the air bubbles are taken into the detergent-containing water upstream of the check valve 60.

Having described one embodiment of means for generating microbubbles of air in the detergent-containing water in accordance with each of the first through sixth version of the invention, it is believed obvious that other modifications and variations will be suggested to those skilled in the art in the light of the above teachings. It is therefore to be understood that changes may be made in the particular embodiment of each of the subcombinational constituent elements of each of six versions of the microbubble generating means of the washing machine in compliance with the present invention described which are within the full intended scope of the invention as defined by appended claims.

What is claimed is:

1. A washing machine equipped with means for generating microbubbles of air comprising:

(1) a washing machine body;

(2) an essentially stationary outer tub disposed inside of said washing machine body for receiving detergent-containing water therein and having at least one drain hole disposed in an outer surface thereof;

(3) an inner tub disposed inside of said outer tub for taking the detergent-containing water and laundry therein and having at least one opening formed in a peripheral surface thereof;

(4) means for rotating said inner tub, the rotating means being coupled to said inner tub; and (5) means for generating microbubbles of air in the detergent-containing water, which is disposed at a bottom portion of said outer tub, wherein said microbubble generating means comprises:

(a) an upstream detergent-containing water guide tube, one end of which is connected to said outer tub;

(b) strainer means for filtering out solid materials contained in the detergent-containing water, upstream end of which is connected to the other end of said upstream detergent-containing water guide tube;

(c) means for introducing air bubbles into the detergent-containing water with solid materials contained in the detergent-containing water taken out by the strainer means, upstream end of which is connected to downstream end of said strainer means;

(d) a pump for generating microbubbles of air, which has one intake port connected to downstream end of said air-bubble introducing means and one exhaust port for a mixture of the detergent-containing water and the microbubbles of air;

(e) a motor coupled to the pump for providing the pump with rotational power therefor;

(f) a plenum for the mixture having (1) an intake hole disposed at a bottom portion of an outer surface thereof for intake of the mixture supplied through the exhaust port of the pump, (2) an air vent hole disposed at a top portion of the outer surface thereof to which a pressure relief valve is installed for preservation of safety therefor, and (3) an exhaust opening disposed in the outer surface thereof for exhaust of the mixture, the exhaust opening being disposed at an elevation lower than that of the air vent hole;

(g) a pressure-regulator valve connected to the exhaust opening and set such that the mixture in between the exhaust port of the pump and the pressure-regulator valve is subject to a pressure higher than the ambient pressure; and (h) a downstream microbubble-containing water guide tube connected between said pressure-regulator valve and said outer tub so that the detergent-containing water in the outer tub is circulated therethrough as far as the pump is in operation;

whereby each of the air bubbles introduced into the detergent-containing water through the air-bubble introducing means is dynamically broken into a plurality of microbubbles of air by a leading edge of one selected from a group consisting of at least one rotor vane of the pump, at least one stator vane of the pump, and each of at least one rotor vane and at least one stator vane of the pump.

2. The washing machine in compliance with claim 1, wherein the pump is of at least two stages in pumping action thereof.

3. A washing machine equipped with means for generating microbubbles of air comprising:

(1) a washing machine body;

(2) an essentially stationary outer tub disposed inside of said washing machine body for receiving detergent-containing water therein and having at least one drain hole disposed in an outer surface thereof;

(3) an inner tub disposed inside of said outer tub for taking the detergent-containing water and laundry therein and having at least one opening formed in a peripheral surface thereof;

(4) means for rotating said inner tub, the rotating means being coupled to said inner tub; and (5) means for generating microbubbles of air in the detergent-containing water, which is disposed at a bottom portion of said outer tub, wherein said microbubble generating means comprises:

(a) an upstream detergent-containing water guide tube, one end of which is connected to said outer tub;

(b) strainer means for filtering out solid materials contained in the detergent-containing water, upstream end of which is connected to the other end of the upstream detergent-containing water guide tube;

(c) means for introducing air bubbles into the detergent-containing water with solid materials contained in the detergent-containing water taken out by the strainer means, upstream end of which is connected to downstream end of said strainer means;

(d) a pump for generating microbubbles of air, which has one intake port connected to downstream end of the air-bubble introducing means and one exhaust port for a mixture of the detergent-containing water and the microbubbles of air;

(e) a motor coupled to the pump for providing the pump with rotational power therefor;

(f) a pressure-regulator valve connected to the exhaust opening and set such that the mixture in between the exhaust port of the pump and the pressure-regulator valve is subject to a pressure higher than the ambient pressure; and (g) a downstream microbubble-containing water guide tube connected between said pressure-regulator valve and said outer tub so that the detergent-containing water in the outer tub is circulated therethrough as far as the pump is in operation;

whereby each of the air bubbles introduced into the detergent-containing water through the air-bubble introducing means is dynamically broken into a plurality of microbubbles of air by a leading edge of one selected from a group consisting of at least one rotor vane of the pump, at least one stator vane of the pump, and each of at least one rotor vane and at least one stator vane of the pump.

4. The washing machine in compliance with claim 3, wherein the pump is of at least two stages in pumping action thereof.

5. The washing machine in compliance with any one of claims 1, 2, 3 and 4, wherein said means for introducing air bubbles into the detergent-containing water comprises:

(a) a suction tube having at least one air suction opening formed in a circumferential surface thereof, upsteam and downstream end of which is connected to the downstream end of the strainer means and the intake port of the pump respectively; and (b) means for confining said circumferential surface of the suction tube, an outer surface of the confinement means having therein at least one air inlet at an elevation not lower than that of the air suction opening.

6. The washing machine in compliance with any one of claims 1, 2, 3 and 4, wherein said means for introducing air bubbles into the detergent-containing water comprises:

(a) means for pressuring air;

(b) means for containing pressurized air from the air-pressurizing means, an outer surface of the containment means having therein a pressurized-air exhaust port and a pressurized-air intake port for intake of the pressurized air from the air-pressurizing means;

(c) a pressure regulator, one end of which is connected to the pressurized-air exhaust port, (d) an air feeding tube having at least one air feeding opening formed in a circumferential surface thereof, upsteam and downstream end of which is connected to the downstream end of the strainer means and the intake port of the pump respectively; and (e) means for confining said circumferential surface of the air feeding tube, an outer surface of the confinement means having therein at least one air intake port connected to the other end of the pressure regulator;

whereby the pressurized air in the containment means is supplied into the confinement means so that the pressurized air in the confinement means is fed through the air-feeding opening into the detergent-containing water flowing through the air-feeding tube.

7. A washing machine equipped with means for generating microbubbles of air comprising (1) a washing machine body;

(2) an essentially stationary outer tub disposed inside of said washing machine body for receiving detergent-containing water therein and having at least one drain hole disposed in an outer surface thereof;

(3) an inner tub disposed inside of said outer tub for taking the detergent-containing water and laundry therein and having at least one opening formed in a peripheral surface thereof;

(4) means for rotating said inner tub, the rotating means being coupled to said inner tub; and (5) means for generating microbubbles of air in the detergent-containing water, which is disposed at a bottom portion of said outer tub, wherein said microbubble generating means comprises:

(a) an upstream detergent-containing water guide tube, one end of which is connected to said outer tub;

(b) strainer means for filtering out solid materials contained in the detergent-containing water, upsteam end of which is connected to the other end of the upstream detergent-containing water guide tube;

(c) a check valve, upstream end of which is connected to downstream end of said strainer means such that the detergent-containing water past the check valve is prevented from flowing in reverse flow direction of the detergent-containing water;

(d) means for feeding air bubbles into the detergent-containing water with solid materials contained in the detergent-containing water taken out by the strainer means, upstream end of which is connected to downstream end of said check valve;

(e) a pump for generating microbubbles of air, which has one intake port connected to downstream end of the air-bubble feeding means and one exhaust port for a mixture of the detergent-containing water and the microbubbles of air;

(f) a motor coupled to the pump for providing the pump with rotational power therefor;

(g) a plenum for the mixture having (1) an intake hole disposed at a bottom portion of an outer surface thereof for intake of the mixture supplied through the exhaust port of the pump, (2) an air vent hole disposed at a top portion of the outer surface thereof to which a pressure relief valve is fitted for preservation of safety therefor, and (3) an exhaust opening disposed in the outer surface thereof for exhaust of the mixture, the exhaust opening being disposed at an elevation lower than that of the air vent hole;

(h) a pressure-regulator valve connected to the exhaust opening and set such that the mixture in between the exhaust port of the pump and the pressure-regulator valve is subject to a pressure higher than the ambient pressure; and (i) a downstream microbubble-containing water guide tube connected between said pressure-regulator valve and said outer tub so that the detergent-containing water in the outer tub is circulated therethrough as far as the pump is in operation;

whereby each of the air bubbles fed into the detergent-containing water through the air-bubble feeding means is dynamically broken into a plurality of microbubbles of air by a leading edge of one selected from a group consisting of at least one rotor vane of the pump, at least one stator vane of the pump, and each of at least one rotor vane and at least one stator vane of the pump.

8. The washing machine in compliance with claim 7, wherein the pump is of at least two stages in pumping action thereof.

9. A washing machine equipped with means for generating microbubbles of air comprising (1) a washing machine body;

(2) an essentially stationary outer tub disposed inside of said washing machine body for receiving detergent-containing water therein and having at least one drain hole disposed in an outer surface thereof;

(3) an inner tub disposed inside of said outer tub for taking the detergent-containing water and laundry therein and having at least one opening formed in a peripheral surface thereof;

(4) means for rotating said inner tub, the rotating means being coupled to said inner tub; and (5) means for generating microbubbles of air in the detergent-containing water, which is disposed at a bottom portion of said outer tub, wherein said microbubble generating means comprises:

(a) an upstream detergent-containing water guide tube, one end of which is connected to said outer tub;

(b) strainer means for filtering out solid materials contained in the detergent-containing water, upstream end of which is connected to the other end of the upstream detergent-containing water guide tube;

(c) a check valve, upstream end of which is connected to downstream end of said strainer means such that the detergent-containing water past the check valve is prevented from flowing in reverse flow direction of the detergent-containing water;

(d) means for feeding air bubbles into the detergent-containing water with solid materials contained in the detergent-containing water taken out by the strainer means, upstream end of which is connected to downstream end of said check valve;

(e) a pump for generating microbubbles of air, which has one intake port connected to downstream end of the air-bubble feeding means and one exhaust port for a mixture of the detergent-containing water and the microbubbles of air;

(f) a motor coupled to the pump for providing the pump with rotational power therefor;

(g) a pressure-regulator valve connected to the exhaust port of the pump and set such that the mixture in between the exhaust port of the pump and the pressure-regulator valve is subject to a pressure higher than the ambient pressure; and (h) a downstream microbubble-containing water guide tube connected between said pressure-regulator valve and said outer tub so that the detergent-containing water in the outer tub is circulated therethrough as far as the pump is in operation;

whereby each of the air bubbles fed into the detergent-containing water through the air-bubble feeding means is dynamically broken into a plurality of microbubbles of air by a leading edge of one selected from a group consisting of at least one rotor vane of the pump, at least one stator vane of the pump, and each of at least one rotor vane and at least one stator vane of the pump.

10. The washing machine in compliance with claim 9, wherein the pump is of at least two stages in pumping action thereof.

11. The washing machine in compliance with any one of claims 7, 8, 9 and 10, wherein said means for feeding air bubbles into the detergent-containing water comprises:

(a) means for pressurizing air;

(b) means for containing pressurized air from the air-pressurizing means, an outer surface of the containment means having therein a pressurized-air exhaust port and a pressurized-air intake port for intake of the pressurized air from the -air-pressurizing means;

(c) a pressure regulator, one end of which is connected to the pressurized-air exhaust port;

(d) an air feeding tube having at least one air feeding opening formed in a circumferential surface thereof, upsteam and downstream end of which is connected to the downstream end of the check valve and the intake port of the pump respectively; and (e) means for confining said circumferential surface of the air feeding tube, an outer surface of the confinement means having therein at least one air intake port connected to the other end of the pressure regulator;

whereby the pressurized air in the containment means is supplied into the confinement means so that the pressurized air in the confinement means is fed through the air-feeding opening into the detergent-containing water flowing through the air-feeding tube.

12. The washing machine in compliance with any one of claim 7, 8, 9 and 10, wherein magnitude of pressure setting for the pressure-regulator valve is in a range of 4 to 6 $kgf/cm^2$.

13. The washing machine in compliance with claim 12, wherein said means for feeding air bubbles into the detergent-containing water comprises:

(a) means for pressurizing air;

(b) means for containing pressurized air from the air-pressurizing means, an outer surface of the containment means having therein a pressurized-air exhaust port and a pressurized-air intake port for intake of the pressurized air from the air-pressurizing means;

(c) a pressure regulator, one end of which is connected to the pressurized-air exhaust port;

(d) an air feeding tube having at least one air feeding opening formed in a circumferential surface thereof, upsteam and downstream end of which is connected to the downstream end of the check valve and the intake port of the pump respectively; and (e) means for confining said circumferential surface of the air feeding tube, an outer surface of the confinement means having therein at least one air intake port connected to the other end of the pressure regulator;

whereby the pressurized air in the containment means is supplied into the confinement means so that the pressurized air in the confinement means is fed through the air-feeding opening into the detergent-containing water flowing through the air-feeding tube.

14. A washing machine equipped with means for generating microbubbles of air comprising (1) a washing machine body;

(2) an essentially stationary outer tub disposed inside of said washing machine body for receiving detergent-containing water therein and having at least one drain hole disposed in an outer surface thereof;

(3) an inner tub disposed inside of said outer tub for taking the detergent-containing water and laundry therein and having at least one opening formed in a peripheral surface thereof;

(4) means for rotating said inner tub, the rotating means being coupled to said inner tub; and (5) means for generating microbubbles of air in the detergent-containing water, which is disposed at a bottom portion of said outer tub, wherein said microbubble generating means comprises:

(a) an upstream detergent-containing water guide tube, one end of which is connected to said outer tub;

(b) strainer means for filtering out solid materials contained in the detergent-containing water, upsteam end of which is connected to the other end of the upstream detergent-containing water guide tube;

(c) means for introducing air bubbles into the detergent-containing water with solid materials contained in the detergent-containing water taken out by the strainer means, upstream end of which is connected to downstream end of the strainer means;

(d) a check valve, upstream end of which is connected to the downstream end of said air-bubble introducing means such that the detergent-containing water past the air-bubble introducing means is prevented from flowing in reverse flow direction of the detergent-containing water;

(e) a pump for generating microbubbles of air, which has one intake port connected to downstream end of the check valve and one exhaust port for exhaust of a mixture of the detergent-containing water and the microbubbles of air;

(f) a motor coupled to the pump for providing the pump with rotational power therefor;

(g) a plenum for the mixture having (1) an intake hole disposed at a bottom portion of an outer surface thereof for intake of the mixture supplied through the exhaust port of the pump, (2) an air vent hole disposed at a top portion of the outer surface thereof to which a pressure relief valve is fitted for preservation of safety therefor, and (3) an exhaust opening disposed in the outer surface thereof for exhaust of the mixture, the exhaust opening being disposed at an elevation lower than that of the air vent hole;

(h) a pressure-regulator valve connected to the exhaust opening and set such that the mixture in between the exhaust port of the pump and the pressure-regulator valve is subject to a pressure higher than the ambient pressure; and (i) a downstream microbubble-containing water guide tube connected between said pressure-regulator valve and said outer tub so that the detergent-containing water in the outer tub is circulated therethrough as far as the pump is in operation;

whereby each of the air bubbles introduced into the detergent-containing water through the air-bubble introducing means is dynamically broken into a plurality of microbubbles of air by a leading edge of one selected from a group consisting of at least one rotor vane of the pump, at least one stator vane of the pump, and each of at least one rotor vane and at least one stator vane of the pump.

15. The washing machine in compliance with claim 14, wherein the pump is of at least two stages in pumping action thereof.

16. A washing machine equipped with means for generating microbubbles of air comprising (1) a washing machine body;

(2) an essentially stationary outer tub disposed inside of said washing machine body for receiving detergent-containing water therein and having at least one drain hole disposed in an outer surface thereof;

(3) an inner tub disposed inside of said outer tub for taking the detergent-containing water and laundry therein and having at least one opening formed in a peripheral surface thereof;

(4) means for rotating said inner tub, the rotating means being coupled to said inner tub; and (5) means for generating microbubbles of air in the detergent-containing water, which is disposed at a bottom portion of said outer tub, wherein said microbubble generating means comprises:

(a) an upstream detergent-containing water guide tube, one end of which is connected to said outer tub;

(b) strainer means for filtering out solid materials contained in the detergent-containing water, upsteam end of which is connected to the other end of the upstream detergent-containing water guide tube;

(c) means for introducing air bubbles into the detergent-containing water with solid materials contained in the detergent-containing water taken out by the strainer means, upstream end of which is connected to downstream end of said strainer means;

(d) a check valve, upstream end of which is connected to the downstream end of said air-bubble introducing means such that the detergent-containing water past the air-bubble introducing means is prevented from flowing in reverse flow direction of the detergent-containing water;

(e) a pump for generating microbubbles of air, which has one intake port connected to the downstream end of the check valve and one exhaust port for a mixture of the detergent-containing water and the microbubbles of air;

(f) a motor coupled to the pump for providing the pump with rotational power therefor;

(g) a pressure-regulator valve connected to the exhaust port of the pump and set such that the mixture in between the exhaust port of the pump and the pressure-regulator valve is subject to a pressure higher than the ambient pressure; and (h) a downstream microbubble-containing water guide tube connected between said pressure-regulator valve and said outer tub so that the detergent-containing water in the outer tub is circulated therethrough as far as the pump is in operation;

whereby each of the air bubbles fed into the detergent-containing water through the air-bubble feeding means is dynamically broken into a plurality of microbubbles of air by a leading edge of one selected from a group consisting of at least one rotor vane of the pump, at least one stator vane of the pump, and each of at least one rotor vane and at least one stator vane of the pump.

17. The washing machine in compliance with claim 16, wherein the pump is of at least two stages in pumping action thereof.

18. The washing machine in compliance with any one of claims 14, 15, 16 and 17, wherein said means for introducing air bubbles into the detergent-containing water comprises:

(a) a suction tube having at least one air suction opening formed in a circumferential surface thereof, upsteam and downstream end of which is connected to the downstream end of the strainer means and the upstream end of the check valve respectively; and (b) means for confining said circumferential surface of the suction tube, an outer surface of the confinement means having therein at least one air inlet at an elevation not lower than that of the air suction opening.

19. The washing machine in compliance with any one of claims 14, 15, 16 and 17, wherein said means for introducing air bubbles into the detergent-containing water comprises:

(a) means for pressurizing air;

(b) means for containing pressurized air from the air-pressurizing means, an outer surface of the containment means having therein a pressurized-air exhaust port and a pressurized-air intake port for intake of the pressurized air from the air-pressurizing means;

(c) a pressure regulator, one end of which is connected to the pressurized-air exhaust port;

(d) an air feeding tube having at least one air feeding opening formed in a circumferential surface thereof, upsteam and downstream end of which is connected to the downstream end the strainer means and the upstream end of the check valve respectively; and (e) means for confining said circumferential surface of the air feeding tube, an outer surface of the confinement means having therein at least one air intake port connected to the other end of the pressure regulator;

whereby the pressurized air in the containment means is supplied into the confinement means so that the pressurized air in the confinement means is fed through the air-feeding opening into the detergent-containing water flowing through the air-feeding tube.

* * * * *